US008022302B2

(12) United States Patent
Juengst

(10) Patent No.: US 8,022,302 B2
(45) Date of Patent: Sep. 20, 2011

(54) TELECOMMUNICATIONS WIRE HAVING A CHANNELED DIELECTRIC INSULATOR AND METHODS FOR MANUFACTURING THE SAME

(75) Inventor: Scott Avery Juengst, Sidney, NE (US)

(73) Assignee: ADS Telecommunications, Inc., Eden Prairie, MN (US)

( * ) Notice: Subject to any disclaimer, the term of this patent is extended or adjusted under 35 U.S.C. 154(b) by 63 days.

(21) Appl. No.: 12/496,329

(22) Filed: Jul. 1, 2009

(65) Prior Publication Data

US 2010/0000753 A1 Jan. 7, 2010

Related U.S. Application Data

(60) Provisional application No. 61/133,983, filed on Jul. 3, 2008.

(51) Int. Cl.
*H01B 7/00* (2006.01)

(52) U.S. Cl. ..... 174/110 R; 174/113 R

(58) Field of Classification Search ..... 174/113 R, 174/113 C, 120 R, 110 R
See application file for complete search history.

(56) References Cited

U.S. PATENT DOCUMENTS

| | | | |
|---|---|---|---|
| 326,021 | A | 9/1885 | Cruickshank |
| 504,397 | A | 9/1893 | Marsh |
| 1,008,370 | A | 11/1911 | Robillot |
| 2,386,818 | A | 10/1945 | Seavey |
| 2,556,244 | A | 6/1951 | Weston |
| 2,583,026 | A | 1/1952 | Swift |
| 2,690,592 | A | 10/1954 | Schanz |
| 2,708,176 | A | 5/1955 | Rhodes |
| 2,766,481 | A | 10/1956 | Henning |
| 2,804,494 | A | 8/1957 | Fenton |
| 3,035,115 | A | 5/1962 | Heckel et al. |
| 3,064,073 | A | 11/1962 | Downing et al. |
| 3,086,557 | A | 4/1963 | Peterson |
| 3,422,648 | A | 1/1969 | Lemelson |
| 3,473,986 | A | 10/1969 | Hureau |
| 3,496,281 | A | 2/1970 | McMahon |
| 3,644,659 | A | 2/1972 | Campbell |
| 3,678,177 | A | 7/1972 | Lawrenson |
| 3,771,934 | A | 11/1973 | Delves-Broughton |
| 3,812,282 | A | 5/1974 | Johansson |
| 3,892,912 | A | 7/1975 | Hauck |
| 3,905,853 | A | 9/1975 | Stent |
| 3,911,070 | A | 10/1975 | Lundsager |

(Continued)

FOREIGN PATENT DOCUMENTS

| | | |
|---|---|---|
| BE | 539772 | 7/1959 |

(Continued)

OTHER PUBLICATIONS

International Search Report and Written Opinion mailed Aug. 18, 2009.

*Primary Examiner* — Chau N Nguyen
(74) *Attorney, Agent, or Firm* — Merchant & Gould P.C.

(57) ABSTRACT

The present disclosure relates generally to a telecommunications wire including an electrical conductor and a dielectric insulator surrounding the electrical conductor. The dielectric insulator defines a plurality of channels defining void space containing a material having a low dielectric constant such as air. The channels each run along a length of the electrical conductor. The channels are configured to lower an overall dielectric constant of the dielectric insulator while maintaining desirable mechanical properties such as crush resistance.

25 Claims, 16 Drawing Sheets

U.S. PATENT DOCUMENTS

| | | | |
|---|---|---|---|
| 3,972,970 | A | 8/1976 | Taylor |
| 3,983,313 | A | 9/1976 | Ney et al. |
| 4,050,867 | A | 9/1977 | Ferrentino et al. |
| 4,132,756 | A | 1/1979 | Ferrentino et al. |
| 4,138,457 | A | 2/1979 | Rudd et al. |
| 4,181,486 | A | 1/1980 | Saito |
| 4,321,228 | A | 3/1982 | de Kok |
| 4,731,505 | A | 3/1988 | Crenshaw et al. |
| 4,745,238 | A | 5/1988 | Kotthaus et al. |
| 4,777,325 | A | 10/1988 | Siwinski |
| 5,132,488 | A | 7/1992 | Tessier et al. |
| 5,162,120 | A | 11/1992 | Baxter et al. |
| 5,286,923 | A | 2/1994 | Prudhon et al. |
| 5,742,002 | A | 4/1998 | Arredondo et al. |
| 5,796,044 | A | 8/1998 | Cobian et al. |
| 5,796,046 | A | 8/1998 | Newmoyer et al. |
| 5,821,467 | A | 10/1998 | O'Brien et al. |
| 5,922,155 | A | 7/1999 | Clouet et al. |
| 5,990,419 | A | 11/1999 | Bogese, II |
| 6,064,008 | A | 5/2000 | Craton |
| 6,150,612 | A | 11/2000 | Grandy et al. |
| 6,162,992 | A | 12/2000 | Clark et al. |
| 6,254,924 | B1 | 7/2001 | Brorein et al. |
| 6,303,867 | B1 | 10/2001 | Clark et al. |
| 6,452,105 | B2 | 9/2002 | Badii et al. |
| 6,465,737 | B1 | 10/2002 | Bonato et al. |
| 6,476,323 | B2 | 11/2002 | Beebe et al. |
| 6,476,326 | B1 | 11/2002 | Fuzier et al. |
| 6,573,456 | B2 | 6/2003 | Spruell et al. |
| 6,743,983 | B2 | 6/2004 | Wiekhorst et al. |
| 6,815,617 | B1 | 11/2004 | Gebs et al. |
| 7,049,519 | B2 | 5/2006 | Wiekhorst et al. |
| 7,214,880 | B2 | 5/2007 | Wiekhorst et al. |
| 7,238,886 | B2 | 7/2007 | Wiekhorst et al. |
| 7,511,221 | B2 | 3/2009 | Wiekhorst et al. |
| 7,511,225 | B2 | 3/2009 | Wiekhorst et al. |
| 7,560,648 | B2 | 7/2009 | Wiekhorst et al. |
| 7,759,578 | B2 | 7/2010 | Wiekhorst et al. |
| 2004/0149483 | A1 | 8/2004 | Glew |
| 2004/0256139 | A1 | 12/2004 | Clark |
| 2005/0230145 | A1 | 10/2005 | Ishii et al. |
| 2007/0098940 | A1 | 5/2007 | Heffner |
| 2010/0078193 | A1 | 4/2010 | Wiekhorst et al. |
| 2010/0132977 | A1 | 6/2010 | Wiekhorst et al. |

FOREIGN PATENT DOCUMENTS

| | | |
|---|---|---|
| CA | 524452 | 5/1956 |
| DE | 2133453 | 1/1973 |
| EP | 1 081 720 | 3/2001 |
| GB | 725624 | 3/1955 |
| GB | 811703 | 4/1959 |

TELECOMMUNICATIONS WIRE HAVING A CHANNELED DIELECTRIC INSULATOR AND METHODS FOR MANUFACTURING THE SAME

CROSS REFERENCE TO RELATED APPLICATION

This application claims the benefit of U.S. Provisional Patent Application Ser. No. 61/133,983, filed Jul. 3, 2008, which application is hereby incorporated by reference in its entirety.

TECHNICAL FIELD

The present disclosure relates generally to twisted pair telecommunication wires for use in telecommunication systems. More specifically, the present disclosure relates to twisted pair telecommunications wires having channeled dielectric insulators.

BACKGROUND

Twisted pair cables are commonly used in the telecommunications industry to transmit data or other types of telecommunications signals. A typical twisted pair cable includes a plurality of twisted wire pairs enclosed within an outer jacket. Each twisted wire pair includes wires that are twisted together at a predetermined lay length. Each wire includes an electrical conductor made of a material such as copper, and a dielectric insulator surrounding the electrical conductor.

The telecommunication industry is driven to provide telecommunication cables capable of accommodating wider ranges of signal frequencies and increased bandwidth. To improve performance in a twisted wire pair, it is desirable to lower the dielectric constant (DK) of the insulator surrounding each electrical conductor of the twisted pair. As disclosed in U.S. Pat. No. 7,049,519, which is hereby incorporated by reference, the insulators of the twisted pairs can be provided with air channels. Because air has a DK value of 1, the air channels lower the effective DK value of the insulators thereby providing improved performance.

Providing an insulator with increased air content lowers the effective DK value of the insulator. However, the addition of too much air to the insulator can cause the insulator to have poor mechanical/physical properties. For example, if too much air is present in an insulator, the insulator may be prone to crushing. Thus, effective twisted pair cable design involves a constant balance between insulator DK value and insulator physical properties

SUMMARY

One aspect of the present disclosure relates to a telecommunication wire having a dielectric insulator that exhibits a low dielectric constant in combination with demonstrating desirable mechanical properties such as enhanced crush resistance and suitable fire prevention characteristics. Another aspect of the present disclosure relates to a method for manufacturing a telecommunication wire having a dielectric insulator as described above.

Examples representative of a variety of aspects are set forth in the description that follows. The aspects relate to individual features as well as combinations of features. It is to be understood that both the forgoing general description and the following detailed description merely provide examples of how the aspects may be put to into practice, and are not intended to limit the broad spirit and scope of the aspects.

BRIEF DESCRIPTION OF THE DRAWINGS

Aspects of the disclosure may be more completely understood in consideration of the following detailed description of various embodiments of the disclosure in connection with the accompanying drawings, in which.

DETAILED DESCRIPTION

The present disclosure relates generally to twisted pair telecommunication wires for use in telecommunication systems. More specifically, the present disclosure relates to twisted pair telecommunications wires having channeled dielectric insulators. Dielectric insulators in accordance with the principles of the disclosure exhibit a reduced dielectric constant in combination with demonstrating desirable mechanical properties such as enhanced crush resistance and suitable fire prevention characteristics.

Figure 1:
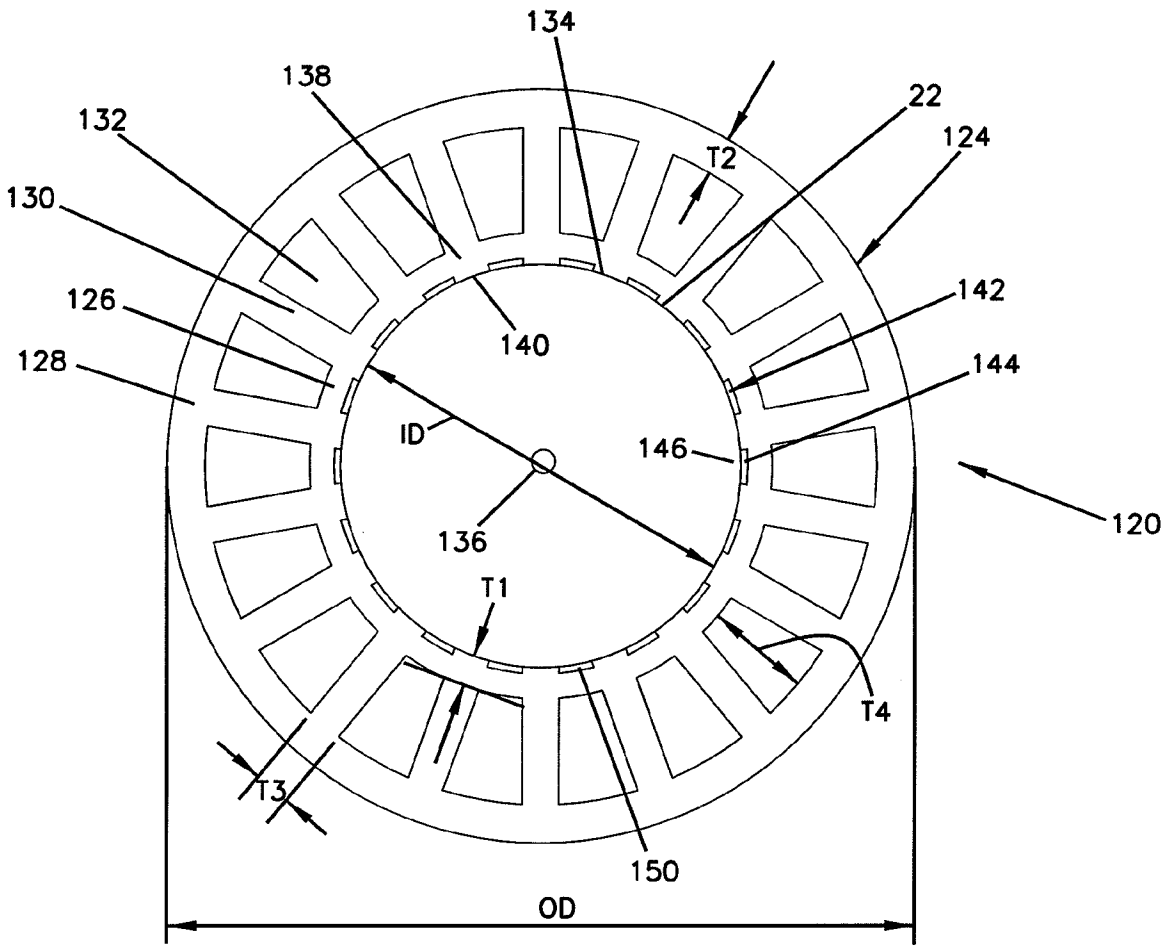
FIG. 1 is a transverse, cross-sectional view of a telecommunication wire having a conductor disposed through a central passageway of a dielectric insulator.

FIG. 1 is a transverse, cross-sectional view of a telecommunication wire 120 having features in accordance with the principles of the present disclosure. The telecommunication wire 120 includes an electrical conductor 22 surrounded by a dielectric insulator 124. The dielectric insulator 124 includes an inner circumferential wall 126 and an outer circumferential wall 128. The outer circumferential wall 128 is spaced radially outwardly from the inner circumferential wall 126. A plurality of radial walls 130 (e.g., spokes) extend from the inner circumferential wall 126 to the outer circumferential wall 128. A plurality of closed channels 132 (e.g., 18 closed channels) are defined within the dielectric insulator 124. For example, the closed channels 132 are shown defined between the inner and outer circumferential walls 126, 128 with the channels 132 being separated from one another by the radial walls 130. A closed channel is a channel that is fully surrounded by or enclosed within portions of the dielectric insulator. The closed channels 132 are preferably filled with a gaseous dielectric material such as air.

The dielectric insulator 124 also includes a plurality of projections or legs 134 that project radially inwardly from the inner circumferential wall 126 toward a center axis 136 of the dielectric insulator 124. The legs 134 have base ends 138 that are integrally formed with an inner side of the inner circumferential wall 126, and free ends 140 that are spaced radially inwardly from the base ends 138. The free ends 140 define an inner diameter (ID) of the dielectric insulator 124. As shown at FIG. 1, the free ends 140 are adapted to engage the outer diameter of the electrical conductor 22. The outer circumferential wall 128 defines an outer diameter (OD) of the dielectric insulator 124.

A plurality of open channels 142 are defined between the legs 134. The open channels 142 of the dielectric insulator 124 are each shown having a transverse cross-section that is notched shaped with open sides/ends 144 located at the inner circumferential wall 126. The open sides/ends 146 face radially toward the center axis 136. The dielectric insulator 124 defines an interior passage 150 having a central region in which the electrical conductor 22 is located, and peripheral regions defined by the open channels 142.

As shown at FIG. 1, each of the open channels 142 is radially aligned with a corresponding one of the closed channels 132. Thus, one of the open channels 142 is provided for each of the closed channels 132. Moreover, it is preferred for the closed channels 132 to be substantially larger in cross-sectional area than the open channels 142. For example, in one embodiment, each of the closed channels 132 is at least two times as large as the cross-sectional area of the corresponding open channel 142. In other embodiments, each of the closed channels 132 has a cross-sectional area that is at least five times as large as the cross-sectional area of its corresponding open channel 142. In still another embodiment, each of the closed channels 132 has a cross-sectional area that is at least ten or twenty times as large as the area of the corresponding open channel 142.

It is preferred for the inner cylindrical wall 126; the outer cylindrical wall 128 and the radial walls 130 to all have approximately the same thickness to facilitate the extrusion process. In calculating the thickness of the inner cylindrical wall 126, the radial lengths of the legs 134 are considered as part of the thickness of the inner circumferential wall 126.

The channels 132, 142 are preferably filled with a material having a low dielectric constant (e.g., a gaseous material such as air). Since air has a dielectric constant of one, to minimize the overall dielectric constant of the dielectric insulator 124, it is desirable to maximize the percent void area within the dielectric insulator 124 that contains air. The percent void area is calculated by dividing the void area defined by a transverse cross-section of the dielectric insulator (i.e., the total transverse cross-sectional area defined by the channels) by the total transverse cross-sectional area defined between the inner and outer diameters of the dielectric insulator.

Referring to FIG. 1, the inner circumferential wall 126 has a wall thickness $T_1$, the outer circumferential wall 128 has a wall thickness $T_2$ and the radial walls 130 have wall thicknesses $T_3$. In one embodiment, the wall thicknesses $T_1$, $T_2$ and $T_3$ can each be in the range of 0.0015-0.0025 inches or preferably about 0.002 inches, the outer diameter of the dielectric insulator 124 can be in the range of 0.041-0.046 or preferably about 0.0435 inches, the inner diameter of the dielectric insulator can be about 0.021-0.025 inches or preferably about 0.023 inches, the minimum material thickness of the dielectric insulator can be in the range of 0.003-0.005 or preferably about 0.004 inches, the maximum material thickness can be in the range of 0.008-0.012 inches or about 0.01025 inches, and the percent void area defined by the dielectric insulator 124 can be in the range of 30-50 percent or about 41 percent. In one embodiment, 8-25 of the closed channels preferably define at least 75 percent of the void area and more preferably define at least 90 percent of the void area. In another embodiment, 13-18 of the closed channels preferably define at least 75 percent of the void area and more preferably define at least 90 percent of the void area.

Figure 2:
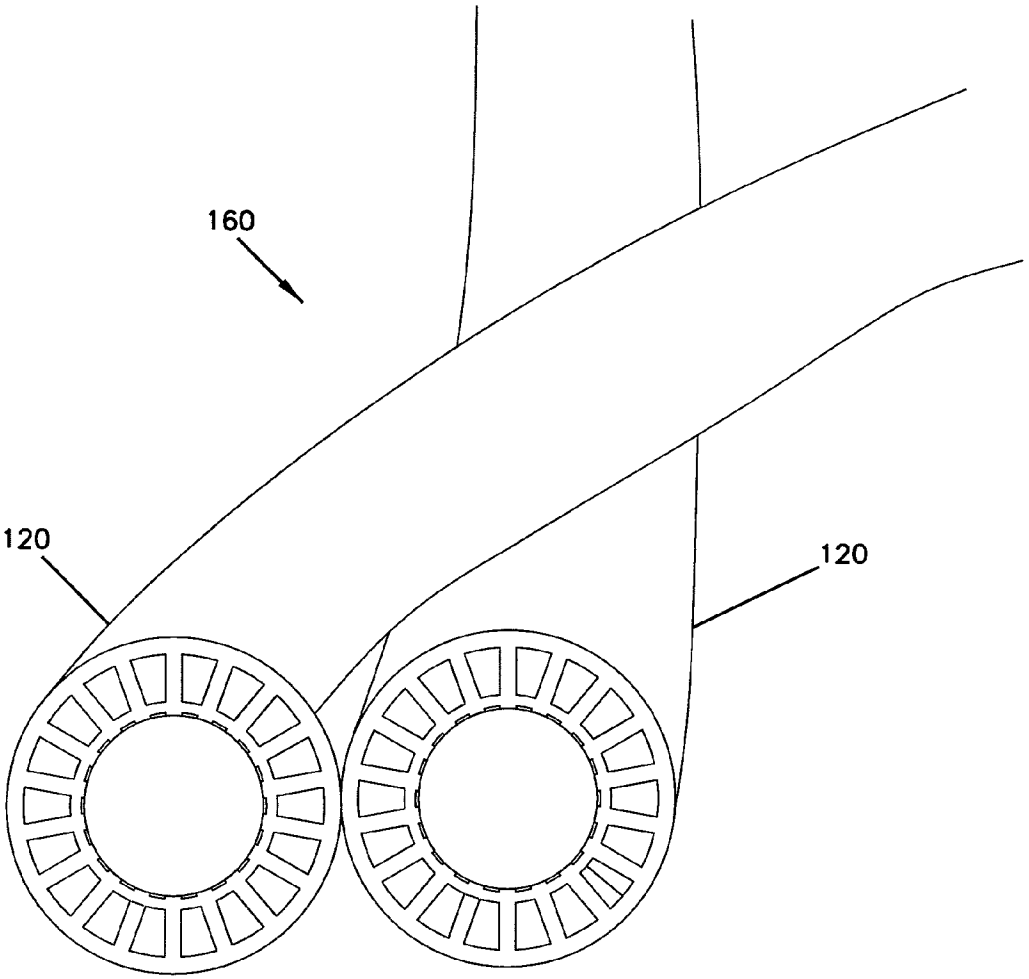
FIG. 2 is perspective view of two of the telecommunication wires of FIG. 1 incorporated into a twisted wire pair.
Figure 3:
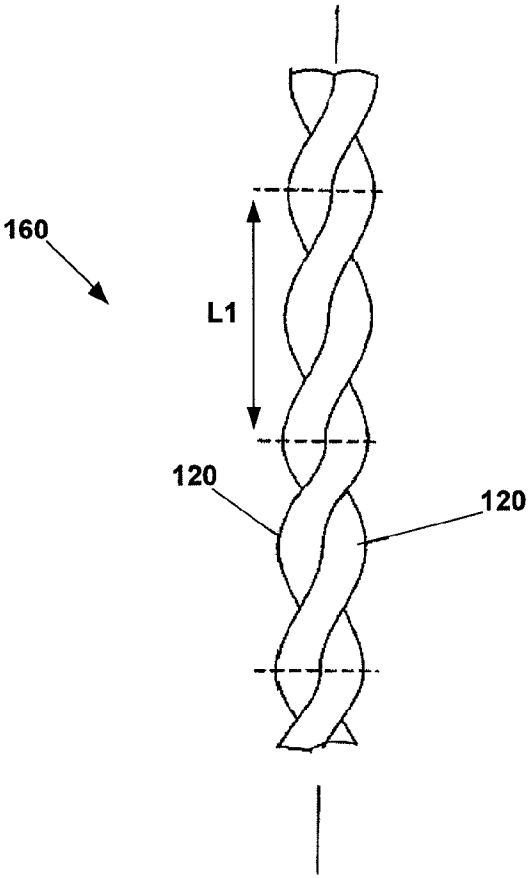
FIG. 3 is a view of a longer segment of the twisted wire pair of FIG. 2.

FIGS. 2-3 show two of the telecommunication wires 120 incorporated into a twisted wire pair 160. As shown in FIG. 3, the telecommunication wires 120 are twisted about one another at a predetermined lay length L1. It will be appreciated that the lay length can be generally constant, can be varied in a controlled manner, and can also be randomly varied. For the crush resistance properties provided by the dielectric insulators 124 of the wires 120, it is desirable for the lay length of the twisted pairs to be in the range of 0.5-0.9 inches, or greater than 0.5 inches.

Figure 4:
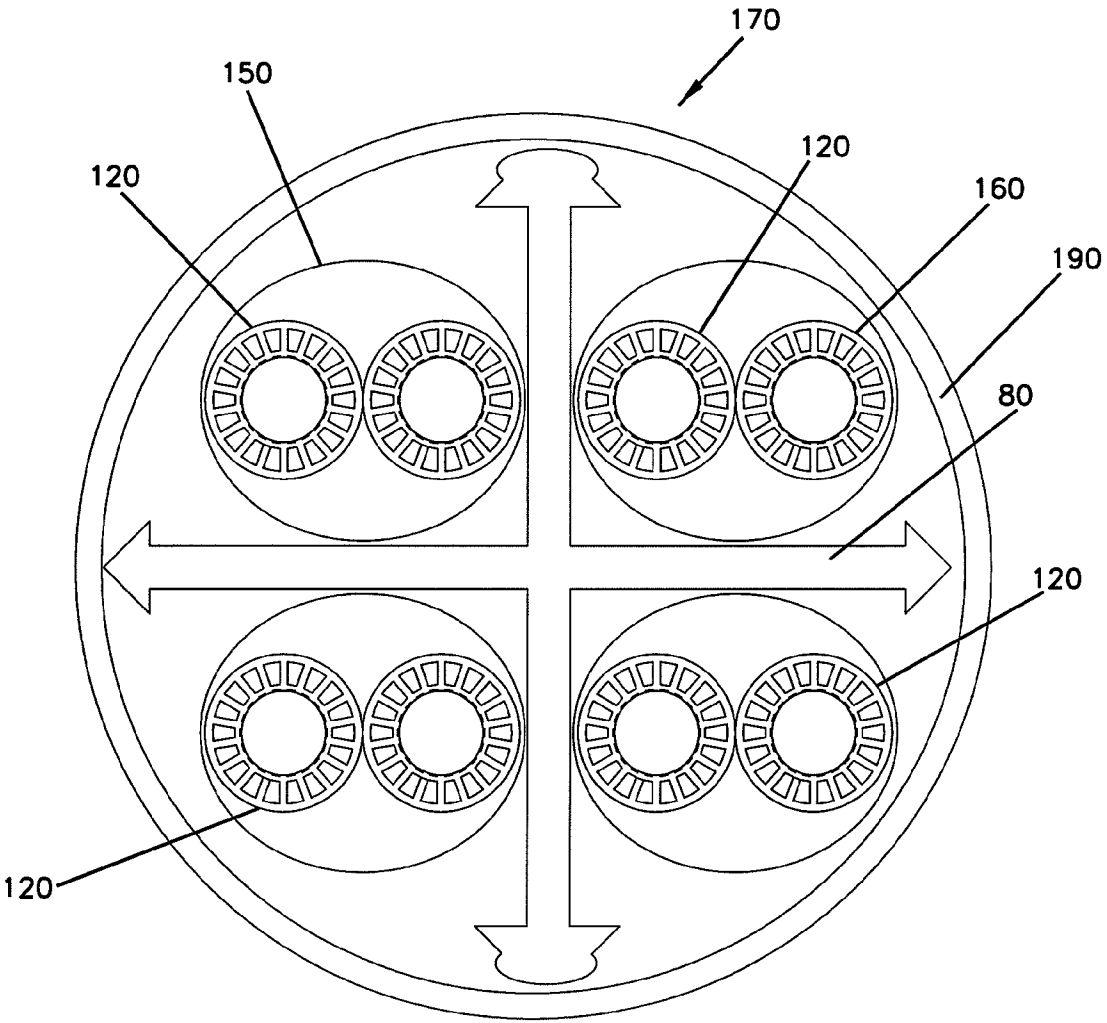
FIG. 4 is a transverse, cross-sectional view of a telecommunication cable having a core that includes four twisted wire pairs of the type shown in FIG. 2.

FIG. 4 shows four of the twisted wire pairs 160 of FIGS. 2-3 incorporated into a four-pair telecommunications cable 170. Outer circles 150 are representative of the outer boundaries defined by the telecommunication wires 120 as the telecommunication wires are twisted around one another to form the twisted wire pairs 160. Four twisted wire pairs 160 are separated by a filler 80 positioned at a central location of the cable 170. In one embodiment, the filler 80 is manufactured of a polymeric dielectric insulator material such as foamed FEP. It will be appreciated that the filler 80 and the four twisted wire pairs 160 define a cable core that is twisted about a center axis of the cable 170 at a predetermined lay length. It will be appreciated that the core lay length can be randomly varied, maintained at a constant length, or varied in a controlled, but non-random manner. An outer jacket 190 covers the cable core.

Figure 5:
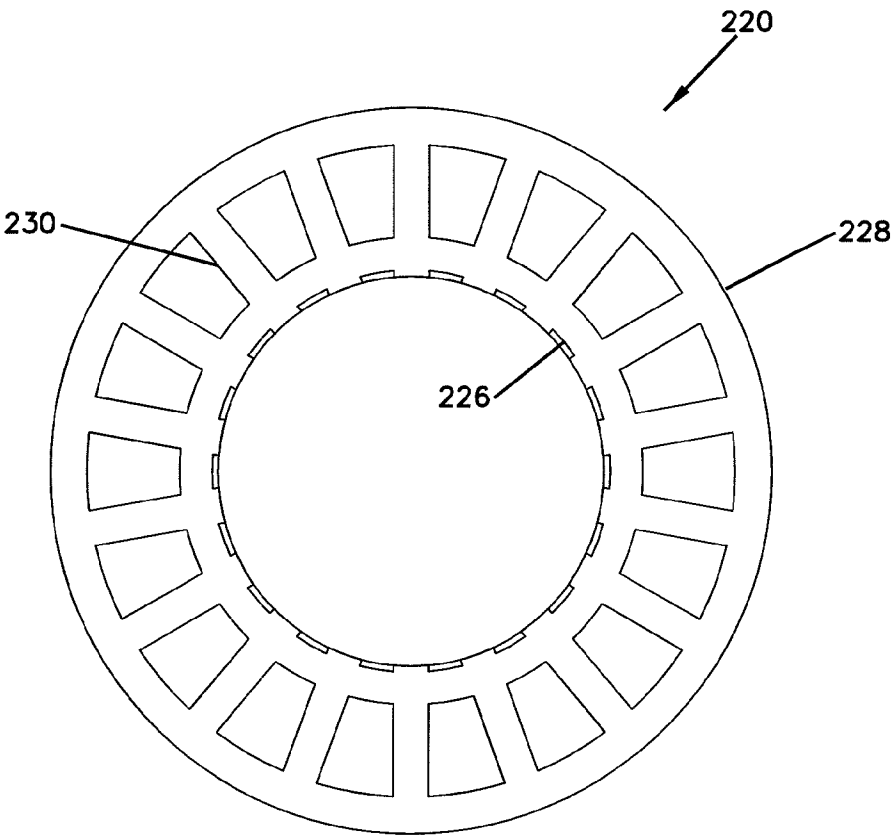
FIG. 5 is a transverse, cross-sectional view of an alternate embodiment of a telecommunication wire.

FIG. 5 shows a further telecommunication wire 220 in accordance with the principles of the present disclosure. The telecommunication wire 220 has the same configuration as the wire 120 of FIG. 1 except an inner circumferential wall 226, an outer circumferential wall 228 and radial walls 230 have an increased thickness to improve crush resistance. For example, in one embodiment, the inner circumferential wall 226, the outer circumferential wall 228 and the radial walls 230 each have a wall thickness in the range of 0.002 to 0.003. Such an embodiment can have a dielectric insulator with an outer diameter of about 0.041-0.046 inches or preferably about 0.0437 inches, an inner diameter of about 0.021-0.025 or preferably about 0.0230 inches, a percent void area in the range of 25-35 percent or preferably about 30 percent, a minimum material thickness of about 0.004-0.006 inches or preferably about 0.0045 inches and a maximum material thickness in the range of in the range of 0.008-0.012 inches or preferably about 0.01025 inches. In one embodiment, 8-25 of the closed channels preferably define at least 75 percent of the void area and more preferably define at least 90 percent of the void area. In another embodiment, 13-18 of the closed channels preferably define at least 75 percent of the void area and more preferably define at least 90 percent of the void area.

Figure 6:
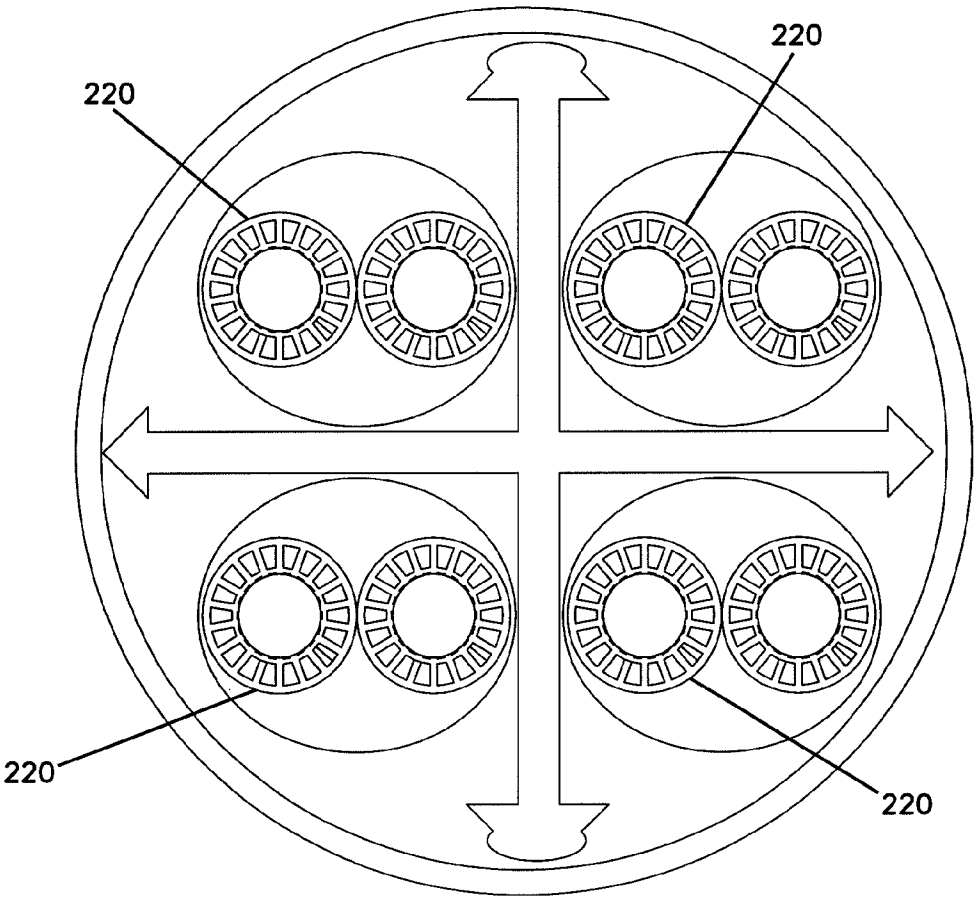
FIG. 6 is a transverse, cross-sectional view of a telecommunication cable having a core that includes four twisted wire pairs of the type shown in FIG. 5.

FIG. 6 shows a plurality of the telecommunication wires 220 twisted into twisted pairs and incorporated into a telecommunications cable of a type described with respect to FIG. 4. For the crush resistance properties provided by the dielectric insulators of the wires 220, it is desirable for the lay length of each of the twisted pairs to be in the range of 0.4-0.9 inches, or greater than 0.4 inches.

Figure 7:
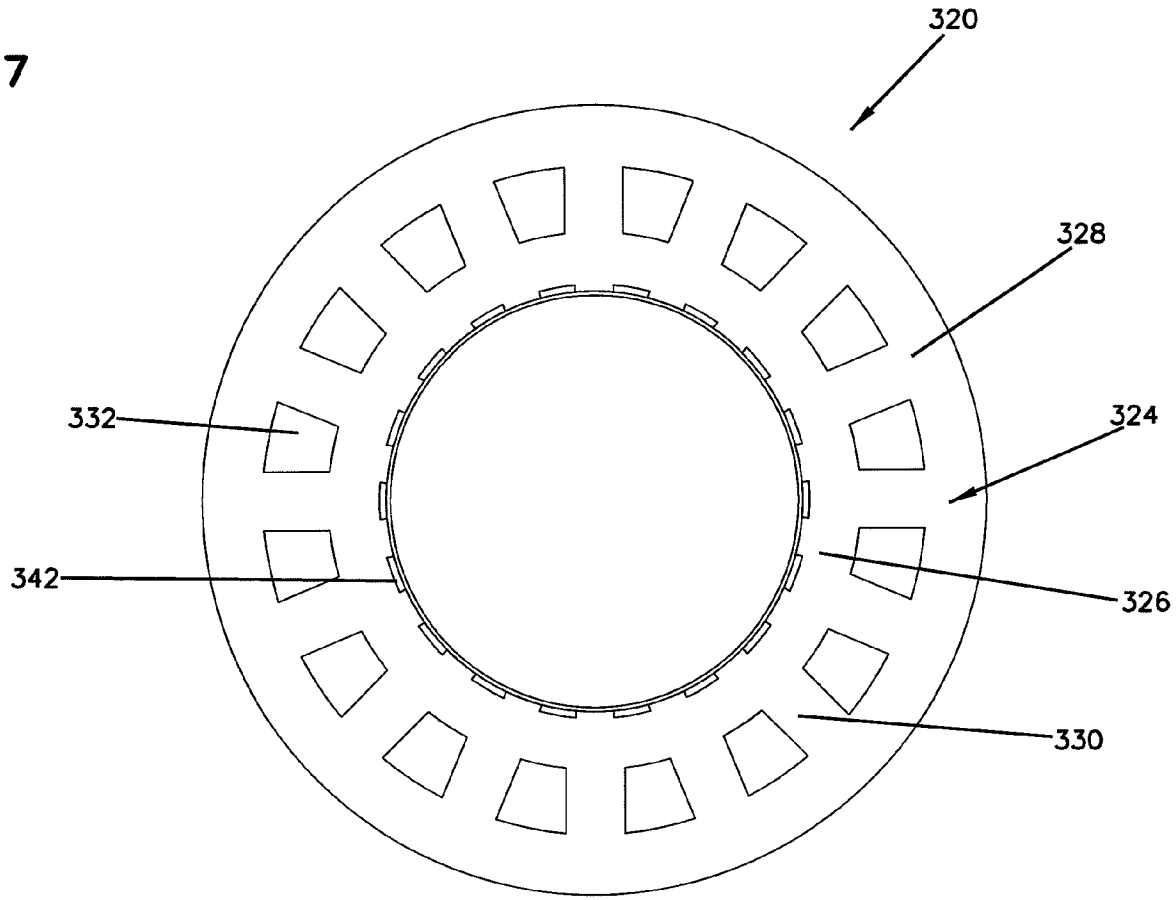
FIG. 7 is a transverse, cross-sectional view of an additional alternate embodiment of a telecommunication wire.

FIG. 7 shows a further telecommunication wire 320 in accordance with the principles of the present disclosure. The telecommunication wire 320 has the same configuration as the telecommunication wire 120, except inner circumferential wall 326, outer circumferential wall 328 and radial walls 330 of dielectric insulator 324 are thicker to provide enhanced crush resistance. Further, the wire 320 only has sixteen radial walls as compared to eighteen as shown in the embodiment of FIG. 1. Thus, the telecommunication wire 320 has sixteen closed channels 332 and eighteen open channels 342. It is preferred for the walls 324, 326 and 328 to each have a thickness T in the range of 0.0027 inches to 0.0033 inches. In a preferred embodiment, the thicknesses T are about 0.003 inches. In the depicted embodiment, the dielectric insulator 324 has an outer diameter in the range of 0.041-0.046 inches or preferably about 0.0437 inches, an inner diameter in the range of 0.021-0.025 or preferably about 0.0230 inches, a percent void area in the range of 15% to 25%, a minimum material thickness in the range of 0.045-0.065 or preferably about 0.0055 inches, and a maximum material thickness of about 0.008-0.012 inches or preferably about 0.01025 inches. Additionally, the dielectric insulator 324 includes a different number of open channels 342 as compared to closed channels 332. For example, the dielectric insulator 324 can include more or fewer open channels 342 as compared to closed channels 332. Additionally, in the dielectric insulator 324, the open channels 342 do not radially align with the closed channels 332. In one embodiment, 13-16 of the closed channels preferably define at least 75 percent of the void area and more preferably define at least 90 percent of the void area.

Figure 8:
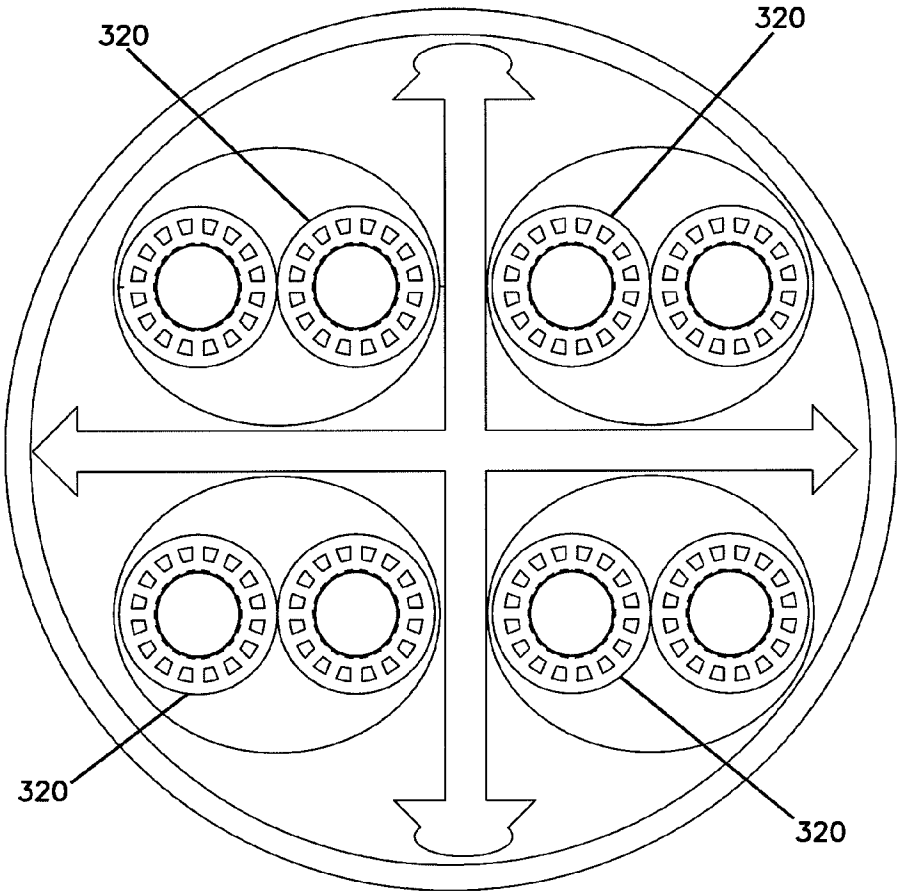
FIG. 8 is a transverse, cross-sectional view of a telecommunication cable having a core that includes four twisted wire pairs of the type shown in FIG. 7.

FIG. 8 shows a plurality of the wires 320 twisted into four sets of twisted pairs and incorporated into a telecommunications cable of the type described with respect to FIG. 4. For the crush resistance properties provided by the dielectric insulators of the wires 320, it is desirable for the lay length of each of the twisted pairs to be in the range of 0.2-0.9 inches or 0.3-0.8 inches. Due to improved crush resistance, the wires 320 can be paired at lay lengths less than 0.4 inches or less than 0.35 inches without experiencing problems related to crushing.

To provide acceptable levels of crush resistance while maximizing the amount of void provided within the dielectric insulator, certain embodiments of the present disclosure have dielectric insulators with more than 8 closed channels, or at least 12 closed channels, or at least 16 closed channels, or at least 18 closed channels. Further embodiments have dielectric insulators with more than 6 open channels or more than 12 open channels, or at least 16 open channels or at least 18 open channels. Still other embodiments have more than 6 open channels and more than 6 closed channels, or more than 12 open channels and more than 12 closed channels, or at least 16 open channels and at least 16 closed channels, or at least 18 open channels and at least 18 closed channels. In certain embodiments, only closed channels may be provided or only open channels may be provided.

To provide acceptable levels of crush resistance while also providing the dielectric insulator with a suitably low dielectric constant, it is desirable to carefully select the percent void area of a given dielectric insulator in accordance with the principles of the present disclosure. Certain embodiments have dielectric insulators with percent void areas in the range of 5-50%, or 15-45%, or 15-40%, or 15-35%, or 15-30%, or 15-25%, or 20-45%, or 20-40%, or 20-35%, or 20-30%, or 20-25%, or 18-23%.

It will be appreciated that dielectric insulators in accordance with the principles of the present disclosure can be made of any number of types of materials such as a solid polymeric material or a foamed polymeric material. In one embodiment, the walls of the insulator can be formed of solid fluorinated ethylene-propylene (FEP) or foamed FEP. While FEP or MFA are preferred materials for manufacturing the walls of the dielectric insulator, it will be appreciated that other materials can also be used. For example, other polymeric materials such as other fluoropolymers can be used. Still other polymeric materials that can be used include polyolefins, such as polyethylene and polypropylene based materials. In certain embodiments, high density polyethylene may also be used.

Dielectric insulators in accordance with the principles of the disclosure preferably have a relatively low dielectric constant in combination with exhibiting desirable mechanical properties such as enhanced crush resistance and suitable fire prevention characteristics. For example, telecommunications wire in accordance with the principles of the present disclosure can be manufactured so as to comply with National Fire Prevention Association (NFPA) standards for how material used in residential and commercial buildings burn. Example standards set by the NFPA include fire safety codes such as NFPA 255, 259 and 262. The UL 910 Steiner Tunnel burn test serves the basis for the NFPA 255 and 262 standards. Telecommunication wires in accordance with the principles of the present disclosure can have various sizes.

In certain embodiments, telecommunication wires in accordance with the principles of the present disclosure can have dielectric insulators with an outer diameter OD in the range of 0.03 to 0.05 inches or in the range of 0.04 to 0.045 inches or less than about 0.060 inches or less than about 0.070 inches. The inner diameters of dielectric insulators in accordance with the principles of the present disclosure generally correspond to the outer diameters of the electrical conductors covered by the dielectric insulators. In certain embodiments, the inner diameters of the dielectric insulators range from 0.015 to 0.030 inches or in the range of 0.018-0.027 inches, or in the range of 0.020-0.025 inches, or less than 0.030 inches.

Electrical conductors in accordance with the principles of the present disclosure preferably are manufactured out of an electrically conductive material such as a metal material such as copper or other materials. It will be appreciated that the electrical conductors in accordance with the principles of the present disclosure can have a solid configuration, a stranded configuration or other configurations such as aluminum coated with a copper or tin alloy.

The channels (e.g., closed or open) of dielectric insulators in accordance with the principles of the present disclosure preferably have lengths that run generally along a length of the electrical conductor. For certain twinning and back twisting operations used to manufacture twisted pair cable, twists can be applied to each of the telecommunication wires of a twisted pair. In this situation, the channels can extend in a helical pattern around the electrical conductor as the channels run generally along the length of the electrical conductor.

In certain embodiments, the wall thicknesses $T_1$, $T_2$ and $T_3$ the walls of dielectric insulators in accordance with the present disclosure (e.g., inner and outer circumferential walls and radial walls) can each have a thickness ranging from 0.0015-0.005 inches, or 0.002-0.004 inches, or 0.002-0.0035 inches, or 0.0025-0.004 inches, 0.0025-0.0035 inches, or 0.0025-0.004 inches, or 0.003-0.004 inches, or 0.003-0.0035 inches, or 0.0027-0.0033 inches. It will be appreciated that the thicknesses of the walls are selected to provide desired levels of crush resistance and desired levels of void space within the dielectric insulator.

To reduce cost, it is desirable to use the minimum amount of material needed to provide adequate levels of crush resistance and relatively low dielectric constant values. In certain embodiments, the minimum material thickness of a dielectric insulator in accordance with the principles of the present disclosure is less than 0.01 inches, or less than 0.007 inches, or less than 0.0065 inches or less than 0.006 inches. In other embodiments, the minimum material thickness of a dielectric insulator in accordance with the principles of the present disclosure is in the range of 0.003-0.007 inches, or 0.0035-0.007 inches, or 0.004-0.007 inches, or 0.0045-0.007 inches, or 0.005-0.007 inches. The minimum material thickness of a dielectric insulator is equal to the minimum total radial thickness of material defined between the outer diameter of the dielectric insulator and the outer diameter of the electrical conductor. In the case of the embodiment of FIG. 1, the minimum material thickness equals the thickness $T_1$ of the inner circumferential wall 26 combined with the thickness $T_2$ of the outer circumferential wall 28. This value equals the total thickness of the dielectric insulator (i.e., the thickness defined between the inner and outer diameters of the dielectric insulator) minus the radial thickness $T_4$ of the channels 32. The maximum material thickness of a dielectric insulator is equal to the maximum total radial thickness of material defined between the outer diameter of the dielectric insulator and the outer diameter of the electrical conductor. In the case of the embodiment of FIG. 1, the maximum material thickness is measured radially through one of the spokes and extends the full radial distance between the outer diameter of the dielectric insulator and the outer diameter of the electrical conductor. In certain embodiments, dielectric insulators in accordance with the principles of the present disclosure have a maximum material thickness in the range of 1.5-6, or 1.5-5, or 1.5-4.0, or 1.5-3.5, or 1.5-3.0, or 1.5-2.5 times as thick as a minimum material thickness.

Figure 9:
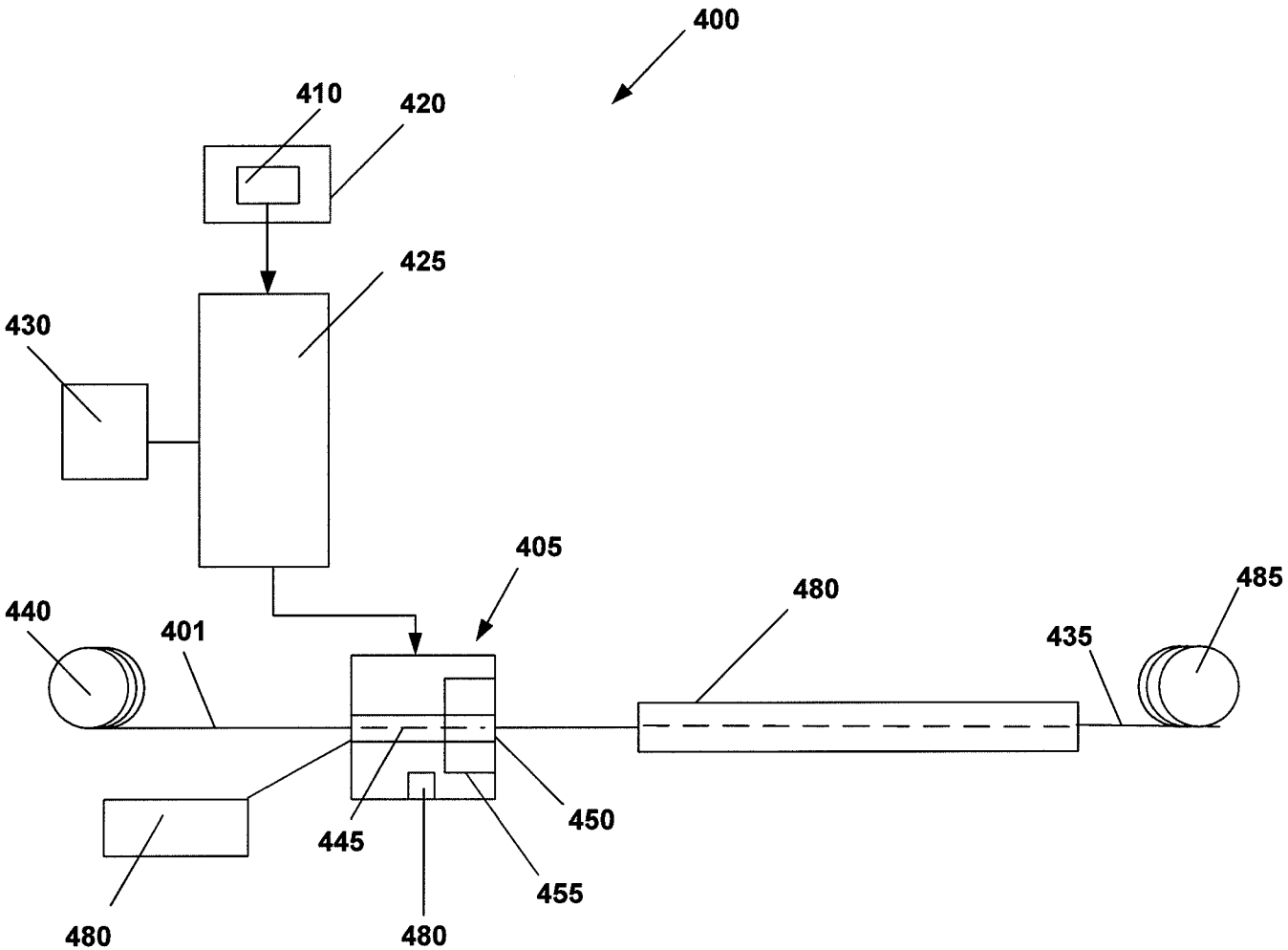
FIG. 9 illustrates a system for manufacturing telecommunication cables in accordance with the principles of the present disclosure.

Referring now to FIG. 9, an example system 400 for use in extruding a dielectric insulator over an electrical conductor 401 is shown. Generally, the system 400 includes a crosshead 405 supporting a tip 450 positioned within a die 455. The system 400 also includes an extruder 425 for forcing a flowable dielectric material (e.g., a thermoplastic material) through the crosshead 405 to form the dielectric insulator about the electrical conductor 401. The extruder 425 can receive the dielectric material from a hopper 420. The extruder 425 can also interface with a heating device 430 that heats the dielectric material to a desired temperature suitable for mixing, flowability and extrusion. The system 400 further includes a spool 440 for feeding the electrical conductor 401 to the crosshead 405, a vacuum source 480 for facilitating drawing down the dielectric material onto the electrical conductor 401 after extrusion, a cooling bath 480 for cooling the dielectric insulator after draw down, and a take-up spool 485 for collecting the wire product after the manufacturing process has been completed.

In use of the system 400, dielectric material 410 is conveyed from the hopper 420 to the crosshead 405 by the extruder 425. Within the extruder, the dielectric material is heated, masticated and pressurized. Pressure from the extruder 425 forces the flowable dielectric material through an annular passageway defined between the tip 450 and the die 455 supported by the crosshead 405. As the thermoplastic material is extruded through the annular passageway between the tip 450 and the die 455, the electrical conductor 401 is fed from the spool 440 and passed through an inner passageway 445 defined by the tip 450. As the dielectric material is passed between the tip 450 and the die 455, a desired transverse cross-sectional shape is imparted to the dielectric material. After the dielectric material has been extruded, the shaped dielectric material is drawn-down upon the electrical conductor 401 with the assistance of vacuum provided by the vacuum source 480 that controls the pressure within the central passage of the extruded dielectric material or with the assistance of pressurized air from a source of compressed air. After the dielectric material has been drawn-down upon the electrical conductor 401, the electrical conductor 401 and the dielectric material are passed through the cooling bath 480 to cool the dielectric material and set a final cross-sectional shape of the dielectric material. Thereafter, the completed telecommunications wire 435 is collected on the take-up spool 485.

Figure 10:
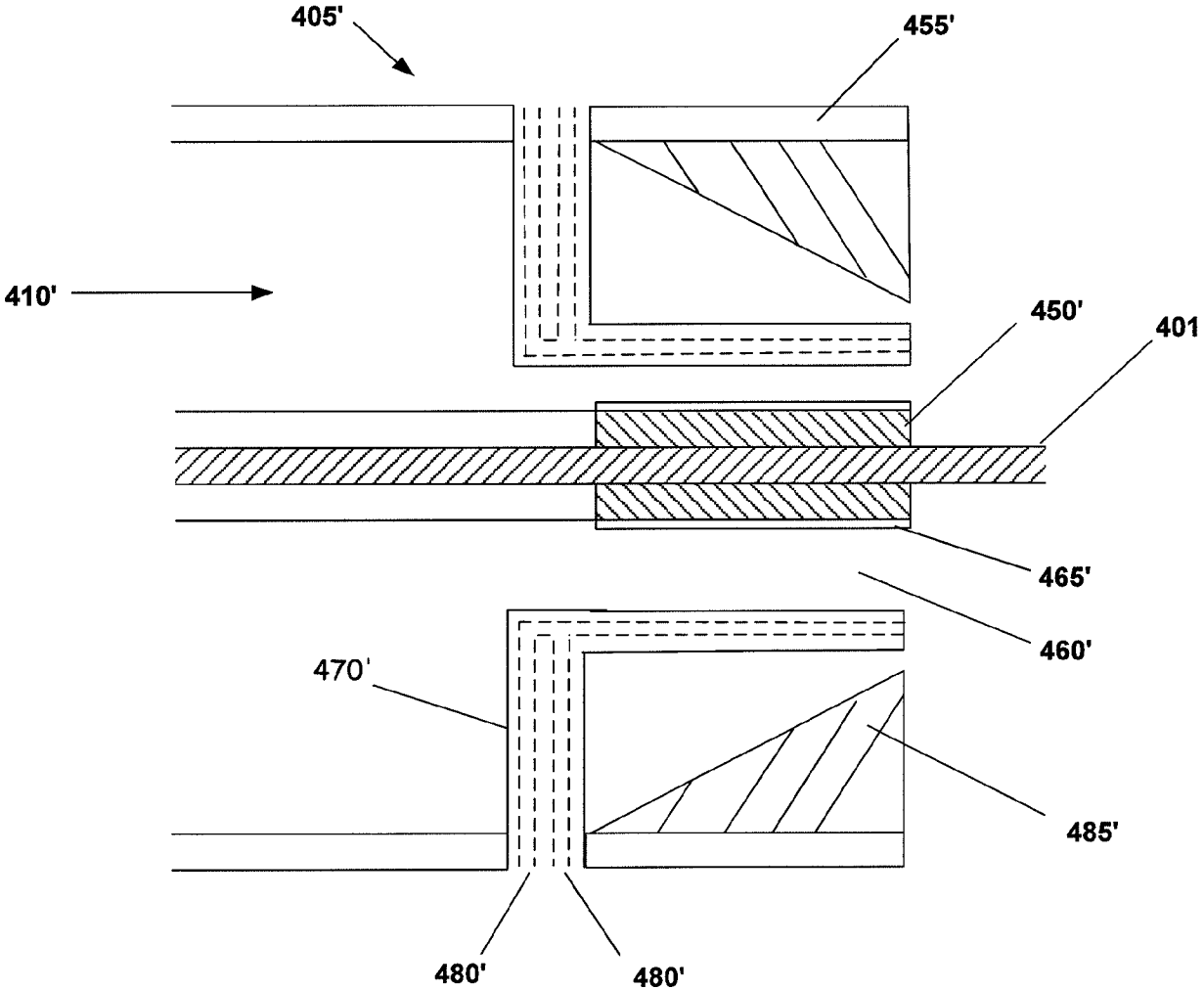
FIG. 10 is a cross-sectional view of an example crosshead tip and die that can be used with the system of FIG. 9.
Figure 11:
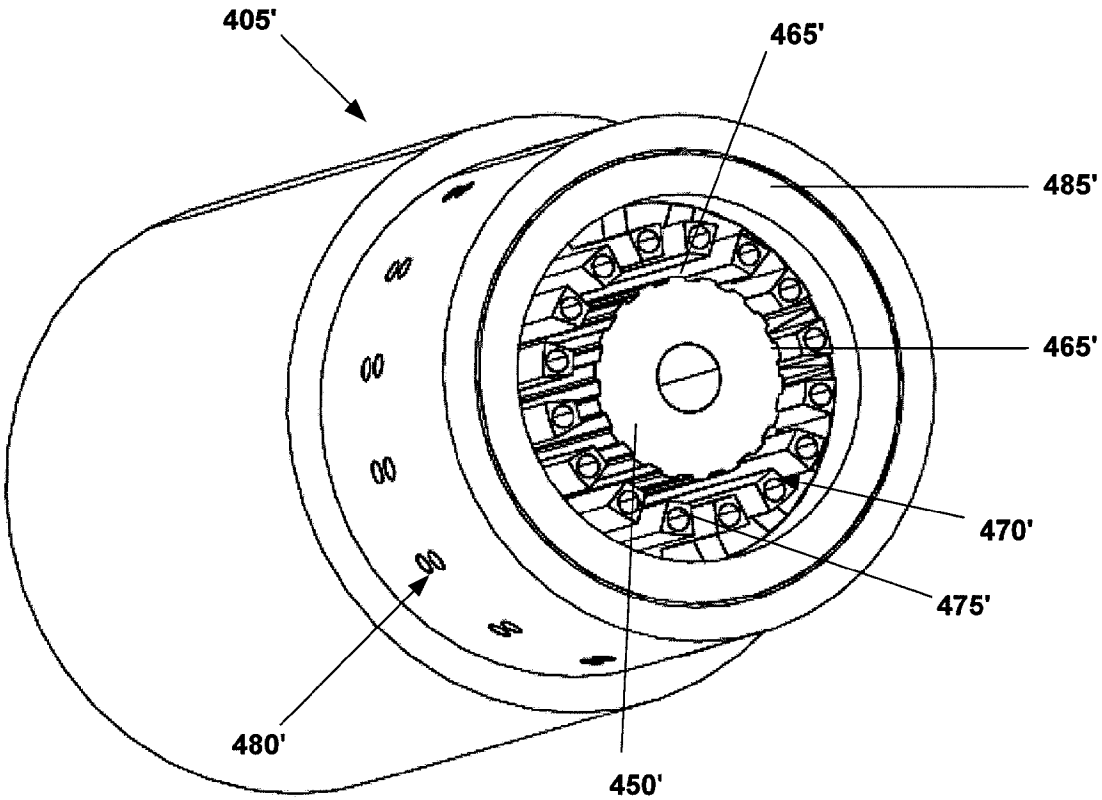
FIG. 11 is a perspective of the example crosshead tip and die of FIG. 10.
Figure 12:
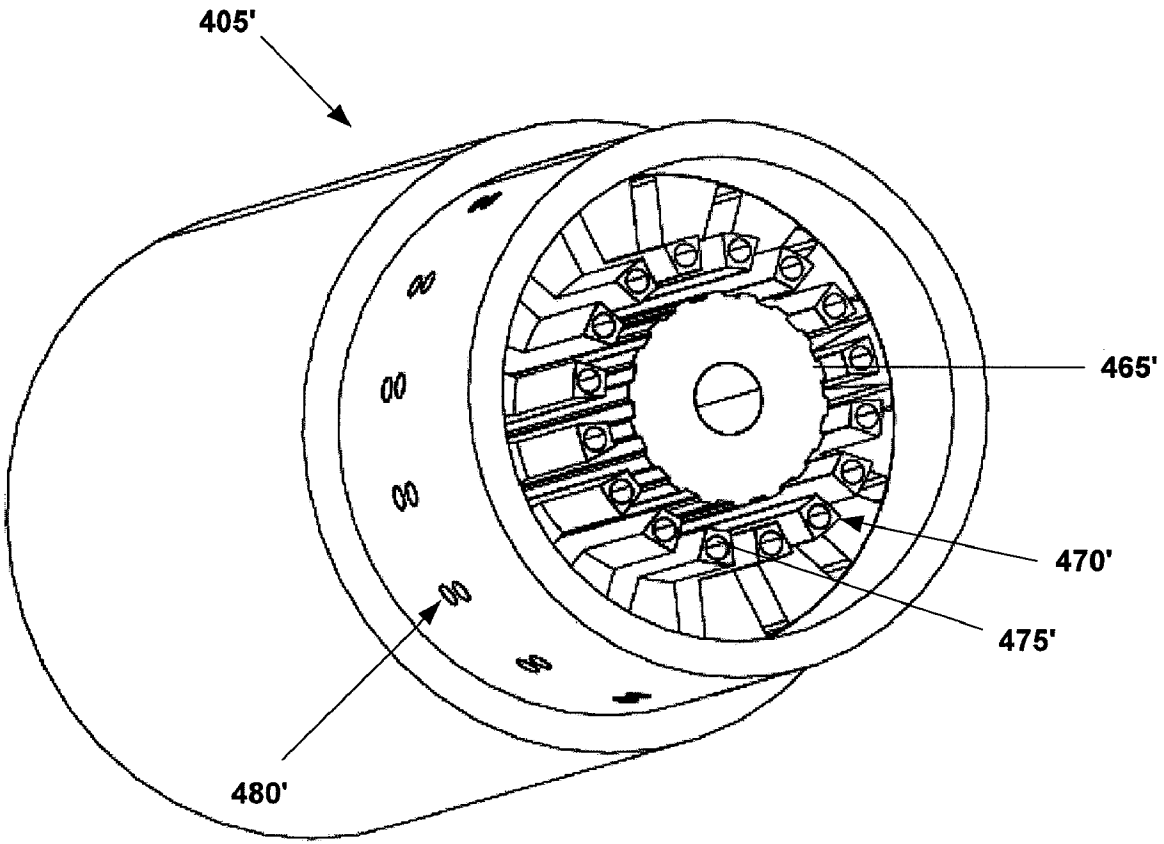
FIG. 12 is a perspective view of an example crosshead tip and die of FIG. 11 having a collar removed from the die.
Figure 14:
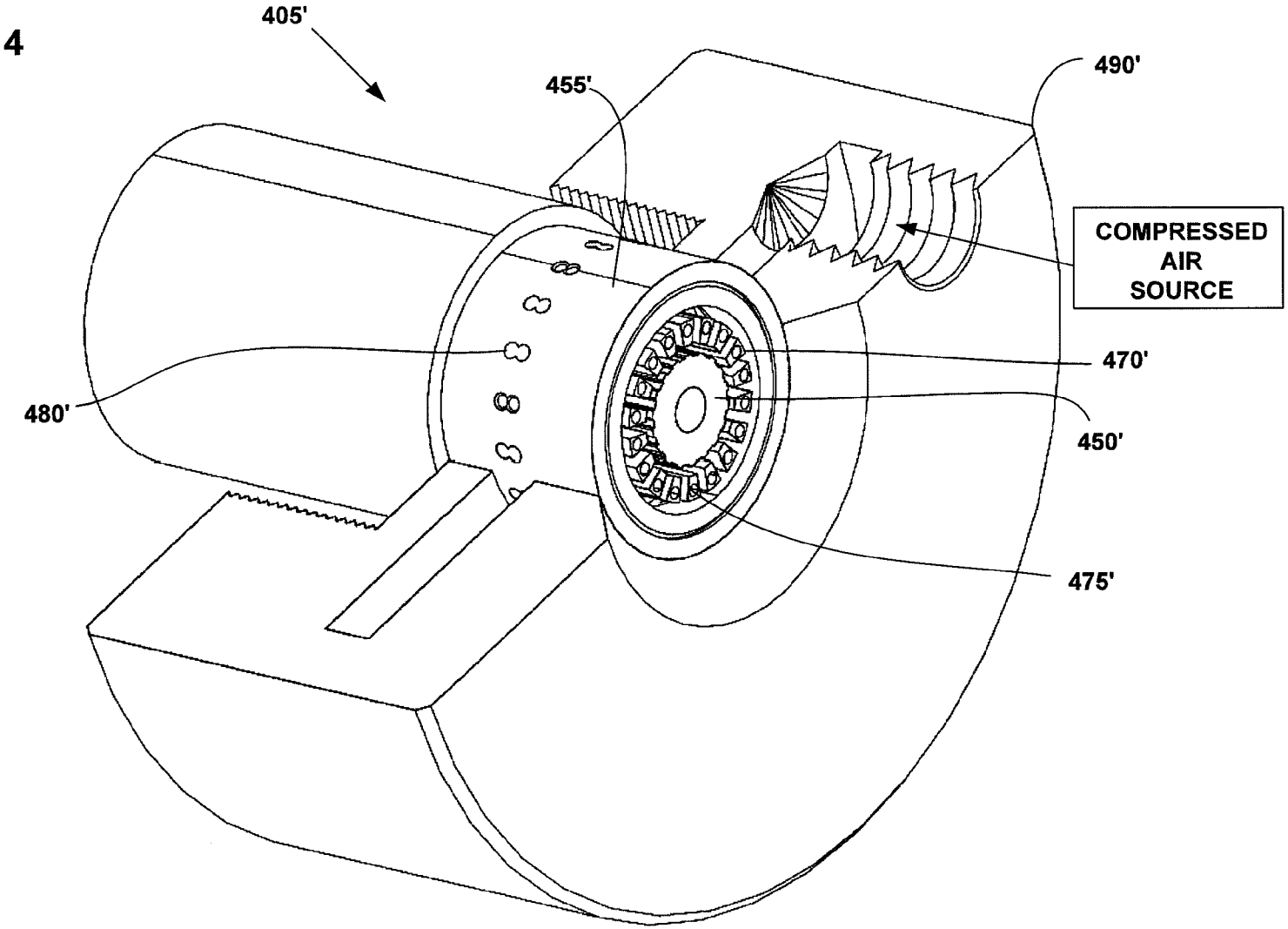
FIG. 14 shows a crosshead tip and die with a pressurization manifold.

FIGS. 10-12 show a tip and die configuration 405' that can be incorporated into the system of FIG. 9 and used to manufacture the telecommunications wire 320 of FIG. 7. The tip and die configuration 405' includes a die 455' and a tip 450' between which an annular extrusion passage 460' is defined. The die 455' is shown including a plurality of axial channel forming members 470' positioned within the annular extrusion passage 460'. The axial channel forming members 470' are configured to form the closed channels 332 of the dielectric insulator 324 when thermal plastic material flows through the extrusion passage 460' and around the channel forming members 470' Each of the respective axial channel forming members 470' includes an air passage 475' to provide air into the closed channels 332 during the extrusion process via one or more holes 480' defined through the die 455'. For example, an air manifold 490' (shown at FIG. 14) can be used to direct pressurized air from a source of compressed air into the holes 480' and through the air passages 475'. Alternatively, air at atmospheric pressure can be drawn into the air passages 475' through the holes 480' during the extrusion process. In other embodiments, different types of gaseous material may supplied to the closed channels 332 during extrusion. For example, in another embodiment, an inert gas such as argon could be used.

Referring still to FIGS. 10-12, the tip 450' includes structure for forming the open channels 342 of the dielectric insulator 324 during the extrusion process. For example, the tip 450' defines a plurality of channel forming members 465' that project radially outwardly from a main body of the tip 450' and into the extrusion passage 460'. During the extrusion process, the dielectric material being extruded through the extrusion passage 460' flows around the channel forming members 465' such that the open channels 342 are formed during the extrusion process. A collar/insert in the form of a truncated cone 485' (see FIG. 10) or other type of tapered structure can be used to funnel the dielectric material into the passage between the tip 450' and the die 455' to ensure that the material flows uniformly throughout the entire open area (i.e., the area not occupied by members 470' or members 465' of the passage 460').

Figure 13:
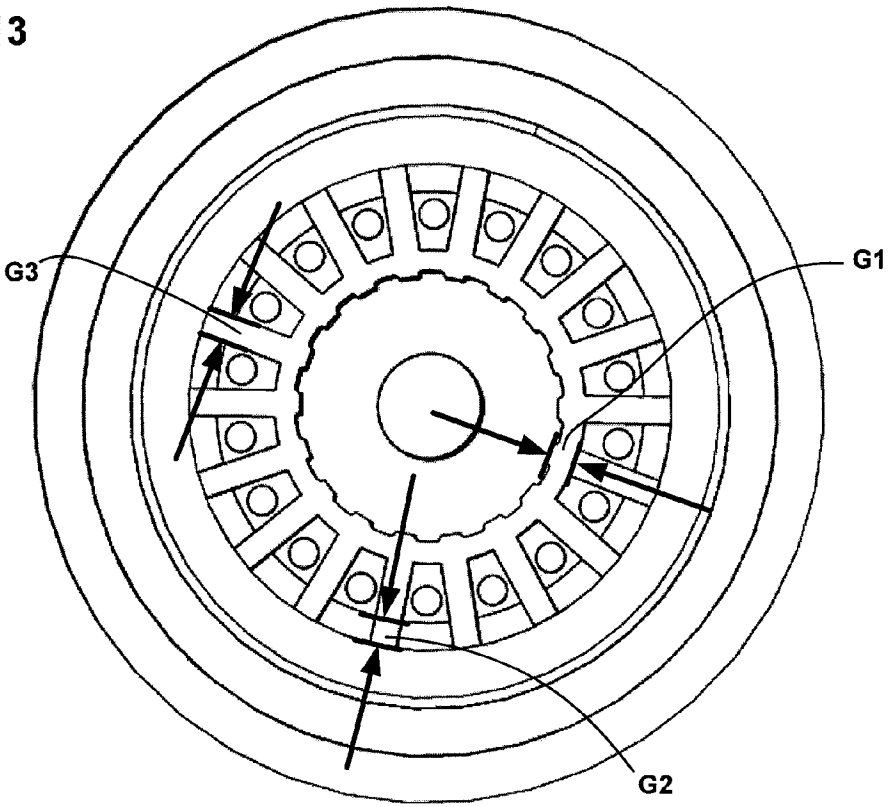
FIG. 13 is an end view of the crosshead of FIG. 11.

Referring to FIG. 13, the tip and die configuration 405' includes a first gap $G_1$ for forming the inner circumferential wall 126, a second gap $G_2$ for forming the outer circumferential wall 128 and gaps $G_3$ for forming the radial walls 130 have wall thicknesses $T_3$. To facilitate extruding the dielectric insulator 324, it is desirable for the gaps to be approximately the same size. For example, in one embodiment, the gap sizes do not vary from one another by more than about 10% or 5%.

For certain applications, it is preferred for a draw-down ratio of at least 50 to 1, or at least 100 to 1, or at least 150 to 1 to be used when extruding dielectric insulators of the type described above. A draw-down ratio is defined as the cross-sectional area of the extruded dielectric formed in the tooling divided by the cross-sectional area of material on the insulated conductor after the drawing process has been completed.

Figure 15:
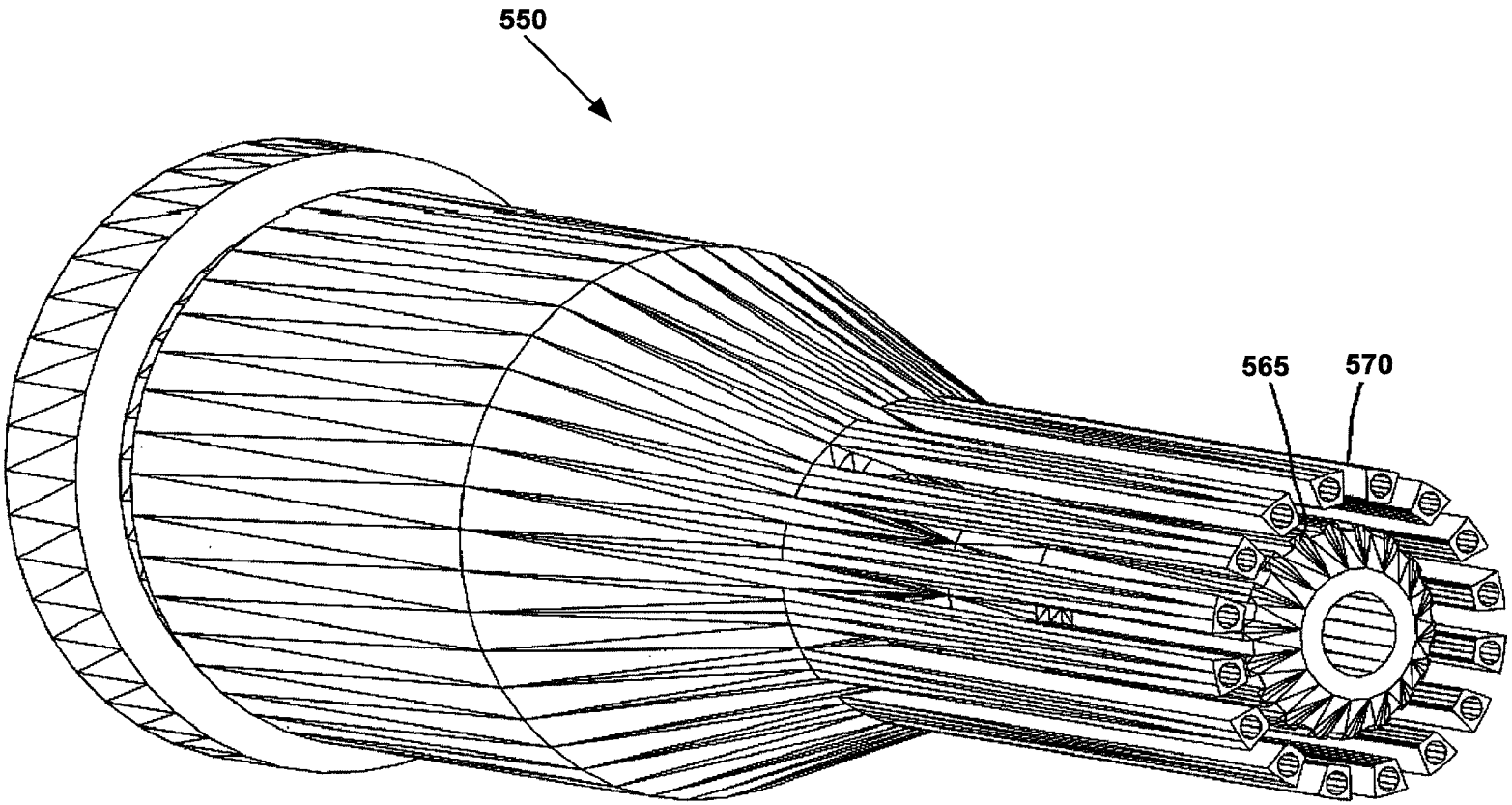
FIG. 15 shows an alternative tip in accordance with the principles of the present disclosure.

FIG. 15 shows an alternative tip arrangement 550 where axial channel defining members 570 for forming the closed channels 332 and projections 565 for forming the open channels 342 are provided on the tip.

Figure 16:
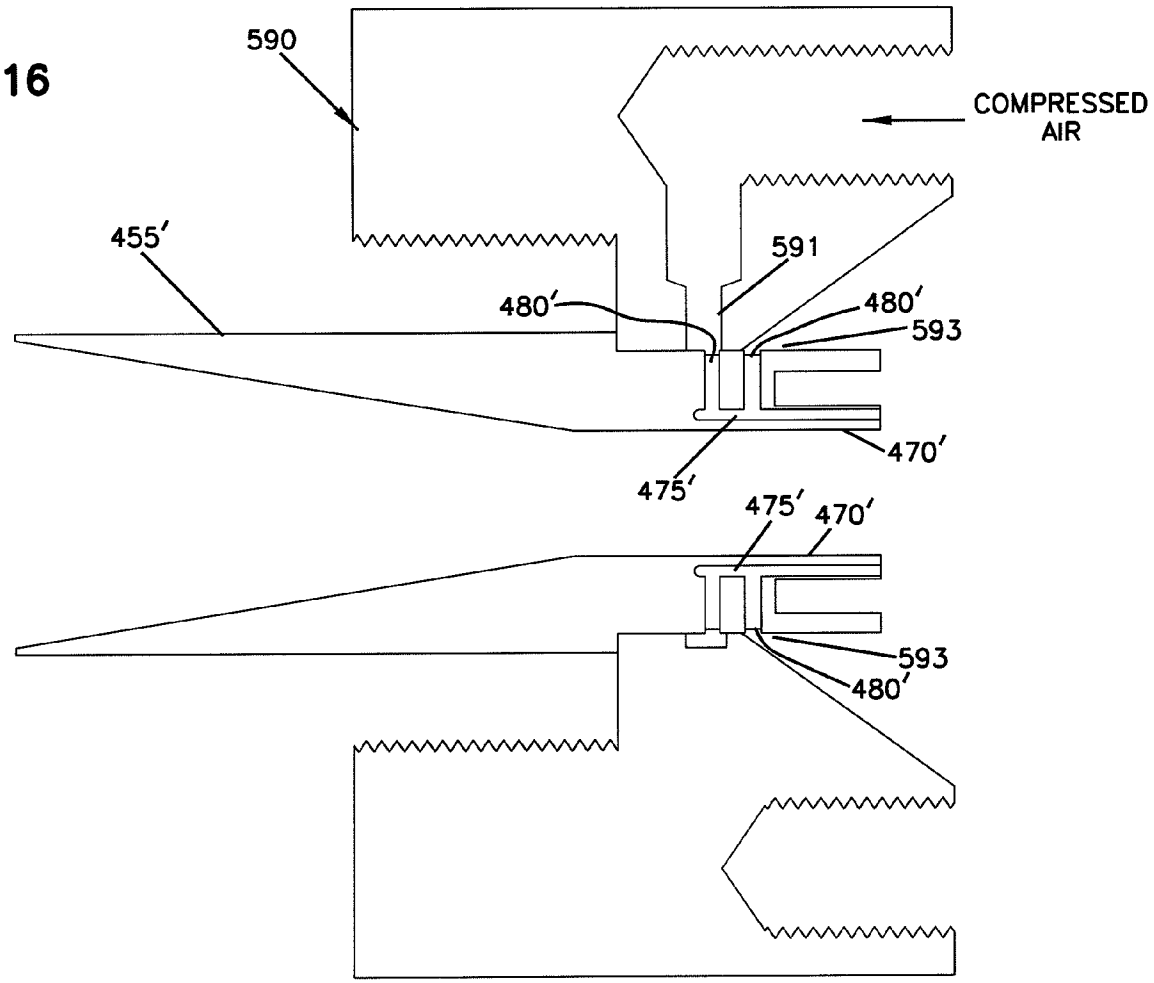
FIG. 16 shows another crosshead die with a pressurization manifold.

FIG. 16 shows a modified compression manifold 590 for providing air to the holes 480' and through the air passages 475' of the axial channel defining members 470' of the die 455'. The manifold 590 includes a first flow path 591 in fluid communication with a source of compressed air for providing compressed air to the passages 475', and a second flow path 593 in fluid communication with atmosphere for allowing excess air to be drawn from atmosphere as needed. In one embodiment, the first flow path has a smaller transverse cross-sectional area from the second flow path.

The preceding embodiments are intended to illustrate without limitation the utility and scope of the present disclosure. Those skilled in the art will readily recognize various modifications and changes that may be made to the embodiments described above without departing from the true spirit and scope of the disclosure.

What is claimed is:

1. A telecommunications wire comprising:

an electrical conductor; and a dielectric insulator surrounding the electrical conductor, the dielectric insulator defining a plurality of closed channels and a plurality of open channels, the closed channels and the open channels defining void space containing a gaseous material, the closed and the open channels being circumferentially spaced about the electrical conductor, the closed channels and the open channels each running generally along a length of the electrical conductor, and the closed channels defining at least 75 percent of the void space, wherein the dielectric insulator includes an outer circumferential wall defining an outer diameter of the dielectric insulator, an inner circumferential wall spaced radially inwardly from the outer circumferential wall, and a plurality of radial walls that extend between the inner and outer circumferential walls, wherein the closed channels are defined between the inner and outer circumferential walls, and wherein the inner circumferential wall, the outer circumferential wall and the radial walls each have a thickness in the range of 0.001 to 0.0035 inches.

2. The telecommunications wire of claim 1, wherein the closed channels define at least 90 percent of the void space.

3. The telecommunications wire of claim 1, wherein the dielectric insulator defines an equal number of the open and closed channels.

4. The telecommunication wire of claim 1, wherein the dielectric insulator defines more of the open channels than the closed channels.

5. The telecommunications wire of claim 1, wherein the open channels are radially aligned with the closed channels.

6. The telecommunications wire of claim 1, wherein the open channels are not radially aligned with the closed channels.

7. The telecommunications wire of claim 1, wherein the dielectric insulator defines at least 16 of the closed channels.

8. The telecommunications wire of claim 1, wherein the dielectric insulator includes a plurality of radial legs that project radially inwardly from the inner circumferential wall and define the open channels thereinbetween.

9. The telecommunications wire of claim 1, wherein the dielectric insulator includes 16 of the closed channels and 18 of the open channels.

10. The telecommunications wire of claim 1, wherein the dielectric insulator defines a percent void area in the range of 5-50 percent.

11. The telecommunications wire of claim 1, wherein the dielectric insulator defines a percent void area in the range of 15-45 percent.

12. The telecommunications wire of claim 1, wherein the dielectric insulator defines a percent void area in the range of 20-35 percent.

13. The telecommunications wire of claim 1, wherein the dielectric insulator defines a percent void area in the range of 15-25 percent.

14. The telecommunications wire of claim 1, wherein the dielectric insulator defines a percent void area in the range of 18-23 percent.

15. The telecommunications wire of claim 1, wherein the dielectric insulator has a minimum material thickness less than 0.007 inches.

16. The telecommunications wire of claim 1, wherein the dielectric insulator has a minimum material thickness in the range of 0.002-0.007 inches.

17. The telecommunications wire of claim 1, wherein the dielectric insulator has a maximum material thickness in the range of 1.5-6 times as thick as a minimum material thickness of the dielectric insulator.

18. The telecommunications wire of claim 1, wherein the dielectric insulator has a maximum material thickness in the range of 1.5-3.0 times as thick as a minimum material thickness of the dielectric insulator.

19. A telecommunications wire comprising:

an electrical conductor; and a dielectric insulator surrounding the electrical conductor, the dielectric insulator defining a plurality of closed channels and a plurality of open channels, the closed channels and the open channels defining void space containing a gaseous material, the closed and the open channels being circumferentially spaced about the electrical conductor, the closed channels and the open channels each running generally along a length of the electrical conductor, and at least one of the closed channels defining a transverse cross-sectional area that is at least two times larger than a transverse cross-sectional area defined by at least one of the open channels, wherein the dielectric insulator includes an outer circumferential wall defining an outer diameter of the dielectric insulator, an inner circumferential wall spaced radially inwardly from the outer circumferential wall, and a plurality of radial walls that extend between the inner and outer circumferential walls, wherein the closed channels are defined between the inner and outer circumferential walls, and wherein the inner circumferential wall, the outer circumferential wall and the radial walls each have a thickness in the range of 0.001 to 0.0035 inches.

20. The telecommunications wire of claim 19, wherein the closed channels have a uniform size and the open channels have a uniform size, and wherein the transverse cross-sectional area defined by each of the closed channels is at least five times larger than the transverse cross-sectional area defined by each of the open channels.

21. The telecommunications wire of claim 19, wherein the closed channels have a uniform size and the open channels have a uniform size, and wherein the transverse cross-sectional area defined by each of the closed channels is at least ten times larger than the transverse cross-sectional area defined by each of the open channels.

22. A telecommunications wire comprising:

an electrical conductor; and a dielectric insulator surrounding the electrical conductor, the dielectric insulator including an outer circumferential wall defining an outer diameter of the dielectric insulator, an inner circumferential wall spaced radially inwardly from the outer circumferential wall, and a plurality of radial walls that extend between the inner and outer circumferential walls, the dielectric insulator also defining more than 12 closed channels between the inner and outer circumferential walls, the outer diameter of the dielectric insulator being less than 0.05 inches;

the dielectric insulator defining a percentage void area in the range of 15-25 percent;

the inner circumferential wall, the outer circumferential wall and the radial walls each having a thickness in the range of 0.001 to 0.0035 inches;

the dielectric insulator having a minimum material thickness in the range of 0.002-0.007 inches; and the dielectric insulator has a maximum material thickness in the range of 1.5-3.0 times as thick as the minimum material thickness of the dielectric insulator, wherein the dielectric insulator also defines open channels having open sides that face toward the electrical conductor, and wherein the closed cells define at least 75 percent of the void area of the dielectric insulator.

23. The telecommunications wire of claim 22, wherein the dielectric insulator defines 13-16 of the channels between the inner and outer circumferential walls.

24. The telecommunications wire of claim 22, wherein the dielectric insulator defines a percentage void area in the range of 18-23 percent.

25. The telecommunications wire of claim 22, wherein the outer circumferential wall and the radial walls each have a thickness in the range of 0.0025-0.0035 inches, and wherein the dielectric insulator has a minimum material thickness in the range of 0.005-0.007 inches.

* * * * *